US010974525B2

(12) United States Patent
Janssen

(10) Patent No.: US 10,974,525 B2
(45) Date of Patent: Apr. 13, 2021

(54) CONTROL OF PRINTING OPERATION OF PRINTING HEADS IN A DIGITAL PRINTING APPARATUS

(71) Applicant: SPGPrints B.V., Boxmeer (NL)

(72) Inventor: Maurice Marinus Anthonius Jozef Janssen, Boxmeer (NL)

(73) Assignee: SPGPrints B.V., Boxmeer (NL)

( * ) Notice: Subject to any disclaimer, the term of this patent is extended or adjusted under 35 U.S.C. 154(b) by 0 days.

(21) Appl. No.: 16/087,880

(22) PCT Filed: Mar. 20, 2017

(86) PCT No.: PCT/NL2017/050171
§ 371 (c)(1),
(2) Date: Sep. 24, 2018

(87) PCT Pub. No.: WO2017/171541
PCT Pub. Date: Oct. 5, 2017

(65) Prior Publication Data

US 2019/0105923 A1 Apr. 11, 2019

(30) Foreign Application Priority Data

Mar. 31, 2016 (NL) ..... 2016518

(51) Int. Cl.
*B41J 29/393* (2006.01)
*B41J 11/00* (2006.01)
(Continued)

(52) U.S. Cl.
CPC ..... *B41J 11/007* (2013.01); *B41J 3/4078* (2013.01); *B41J 3/543* (2013.01); *B41J 11/008* (2013.01); *B41J 11/42* (2013.01)

(58) Field of Classification Search
CPC ..... B41J 11/008; B41J 11/007
(Continued)

(56) References Cited

U.S. PATENT DOCUMENTS 6,179,419 B1 * 1/2001 Rasmussen ..... B41J 11/007 347/104
7,959,248 B2 * 6/2011 Naoi ..... G03G 15/305 347/104
(Continued)

FOREIGN PATENT DOCUMENTS

CN 104290462 A 1/2015
JP 2005-219339 A 8/2005
(Continued)

OTHER PUBLICATIONS

English Version of Chinese Office Action dated Mar. 26, 2020 for a counterpart foreign application.
(Continued)

*Primary Examiner* — Lam S Nguyen
(74) *Attorney, Agent, or Firm* — Hoffmann & Baron, LLP

(57) ABSTRACT

A digital printing apparatus for inkjet printing on a sheet or web of material includes a belt for supporting and conveying the sheet or web of material fixed to the belt. The belt is guided along at least a first roller driven by a motor and a second roller driven by the belt. A plurality of printing heads is arranged along the path of the belt. A control system is configured to control the operation of the motor and the printing operation of the printing heads. A first encoder, being configured to supply a first encoder signal to the control system for controlling the operation of the motor, is associated with the first roller. A second encoder, being configured to supply a second encoder signal to the control system for controlling the printing operation of each printing head, is associated with the second roller.

16 Claims, 3 Drawing Sheets

(51) Int. Cl.
*B41J 11/42* (2006.01)
*B41J 3/407* (2006.01)
*B41J 3/54* (2006.01)

(58) Field of Classification Search
USPC ..... 347/19
See application file for complete search history.

(56) References Cited

U.S. PATENT DOCUMENTS

| | | | | |
|---|---|---|---|---|
| 2006/0202646 | A1 | 9/2006 | Kojima | |
| 2007/0236528 | A1* | 10/2007 | Oike | B41J 11/008 347/19 |
| 2008/0124158 | A1* | 5/2008 | Folkins | G03G 15/0163 399/396 |

FOREIGN PATENT DOCUMENTS

| | | | |
|---|---|---|---|
| JP | 2008-55631 | A | 3/2008 |
| WO | 2015/185101 | A1 | 12/2015 |

OTHER PUBLICATIONS

Japanese Office Action dated Jul. 21, 2020 for a counterpart foreign application, 7 pages.
Japanese Office Action dated Dec. 16, 2020 for a counterpart foreign application, 6 pages.

* cited by examiner

FIG. 1
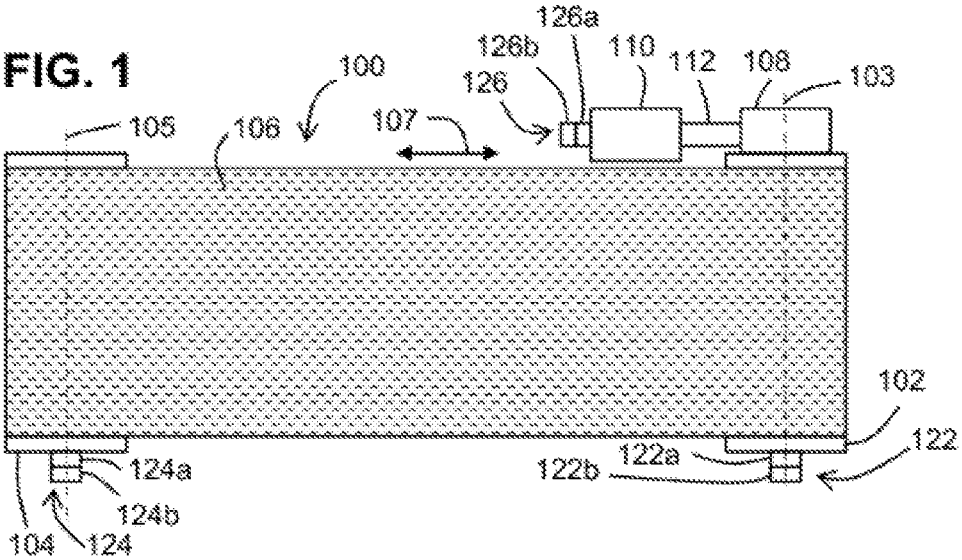
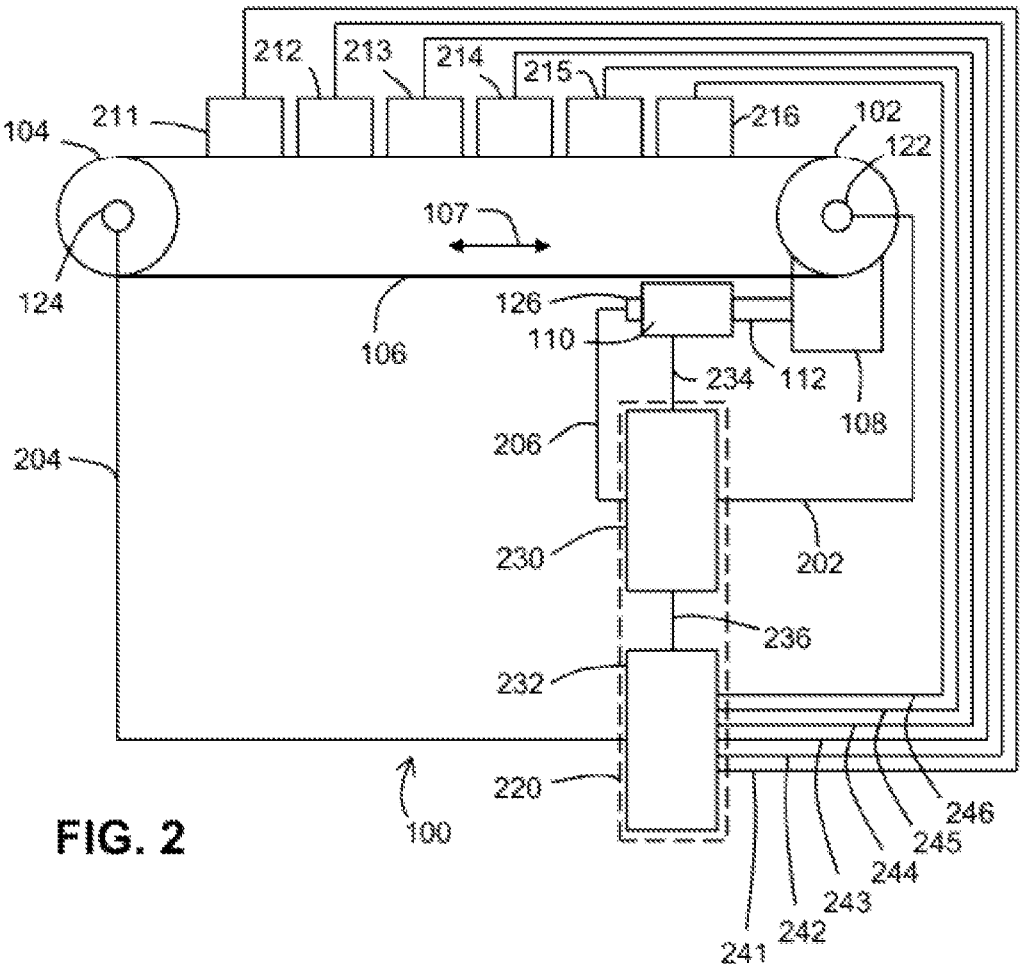
FIG. 2

CONTROL OF PRINTING OPERATION OF PRINTING HEADS IN A DIGITAL PRINTING APPARATUS

CROSS-REFERENCE TO RELATED APPLICATIONS

This application is the National Stage of International Application No. PCT/NL2017/050171, filed Mar. 20, 2017, which claims the benefit of Netherlands Application No. NL 2016518, filed Mar. 31, 2016, the contents of which is incorporated by reference herein.

FIELD OF THE INVENTION

The invention relates to the field of digital printing, and more specifically to a digital textile printing apparatus and method, in which different colors of ink are printed on a textile material, such as a sheet or web of material, by means of an inkjet printer comprising a plurality of printing heads.

BACKGROUND OF THE INVENTION

In a digital printing apparatus comprising an inkjet printer, a sheet or web of material, such as a textile material, is conveyed in a direction of conveyance. In the context of the present invention, a driven belt system is applied to convey the sheet or web of material. The belt system comprises one or more belts guided along cylindrical surfaces of rollers each rotating around a respective axis of rotation. The axes of rotation of the different rollers are essentially parallel. At least one of the rollers is driven by a motor, preferably an electric motor for reason of its high controllability. At least one of the rollers is freely rotatable, i.e. not driven by a motor but by the one or more belts.

The sheet of web of material is adhered to a belt of the belt system in a known way, e.g. fixed by electrostatic forces, or by mechanical fixing such as by clamping, vacuum fixing, adhering by a thermoplastic, or gluing.

A complete printing process involves the application of a printing medium by the inkjet printer on the sheet or web of material (which may have undergone a pre-treatment) to obtain an image thereon, drying medium, fixing the medium. In addition, the medium may undergo a post-treatment. In the context of the present invention, a control of the application of the printing medium on the sheet or web of material is focused on.

Printing heads for basic colors (commonly four or six printing heads for four or six different colors) are mounted one behind the other as seen in the direction of conveyance of the sheet or web of material. Ink droplets are ejected from the printing heads to form a pixel of an image, based on signals received by the printing heads from a controller. Printing quality may e.g. be up to 1200 dots per inch, dpi, as seen in the direction of conveyance of the sheet or web of material, and this requires an accurate positioning of the color ink droplets relative to one another on the sheet or web of material. Thus, the timing of ejecting ink droplets from a particular printing head needs to be accurately controlled with respect to a moving belt supporting a sheet or web of material.

In a control system of the digital printing apparatus, a theoretical axis is defined, which receives a speed command from an operator through a control interface. The axis of the motor driving the belt of the digital printing apparatus is coupled one to one to the theoretical axis. The angular position of the motor axis is sensed by a motor encoder. A servo control of the motor is configured to have the motor axis follow the theoretical axis very closely ("stiff setting") using the motor encoder, so that the position and speed error of the motor during the printing is as low as possible.

At the same time, the motor encoder may provide pulses that are used to control the printing action of each print head.

WO 2015/185101 A1 discloses, inter alia, a medium transport in a print device. The media transport may comprise one or more roller and a belt system. The print medium may be carried by the rollers and belt under print heads. A rotary encoder may be coupled to one of the rollers or a drive mechanism such as an electric motor. The motor encoder may generate an encoder signal representative of the media transport state. This encoder signal may be used to synchronize one or more firing pulse signals for the print heads.

However, the servo control of the motor, as a result of a stiff setting, is not absolutely stable, and can be characterized as "nervous". This makes the signal of the motor encoder less suitable as a pulse generator for controlling the printing operation of the printing heads.

SUMMARY OF THE INVENTION

It would be desirable to provide a digital printing apparatus having an improved control, or at least an alternative control of the printing operation of the printing heads.

To better address this concern, in a first aspect of the invention a digital printing apparatus for inkjet printing on a sheet or web of material is provided, which digital printing apparatus comprises: a belt for supporting and conveying the sheet or web of material fixed to the belt, the belt being guided along at least a first roller and a second roller, wherein the first roller has a first axis of rotation and is driven by a motor to rotate around the first axis of rotation, and the second roller has a second axis of rotation and is driven by the belt to rotate around the second axis of rotation; a plurality of printing heads arranged along the path of the belt; a control system configured to control the operation of the motor and the printing operation of the printing heads; and a first encoder associated with the first roller, the first encoder being configured to supply a first encoder signal to the control system for controlling the operation of the motor. The digital printing apparatus further comprises a second encoder is associated with the second roller, and the second encoder is configured to supply a second encoder signal to the control system for controlling the printing operation of each printing head.

When the first roller drives the belt, the second roller which is driven by the belt but not driven directly by a motor, will act less nervous than the first roller, for reasons of its inertia, and strain in the belt. Here, the belt has a damping function. Since the first encoder is used for controlling the operation of the motor, and the second encoder is used for controlling the printing operation of the printing heads, both the first encoder and the second encoder are necessary to obtain a good printing result by virtue of controlling the belt movement and controlling the associated printing operation of the printing heads.

In an embodiment of the digital printing apparatus, the control system comprises a servo controller for controlling the operation of the motor, and a motion controller for controlling the printing operation of each printing head.

A servo controller, sometimes also referred to as a servo drive, generally receives a command signal from a control system (in this case: a motion controller), amplifies the signal, and transmits electric current to a servo motor (in this case: the motor driving the first roller) in order to produce motion proportional to the command signal. Typically the command signal represents a desired velocity.

The motion controller generates a virtual master axis for input to the servo controller in order for the servo controller to couple the motor to the virtual axis. By a stiff setting (high accuracy and high bandwidth) of the servo control of the motor, the motor will follow the master axis very closely. As a result, the position and speed error of the motor during printing is very low.

The first encoder signal is supplied to the servo controller. The first encoder signal is used in a position control loop of the servo controller.

The second encoder signal is supplied to the motion controller. The second encoder signal is used in a printing head control of the motion controller, for accurately timing ejection of ink droplets from a particular printing head.

In an embodiment, the digital printing apparatus further comprises a third encoder associated with the motor, the third encoder being configured to supply a third encoder signal to the servo controller for further controlling the operation of the motor. The third encoder signal is user in a speed control loop of the servo controller.

In an embodiment of the digital printing apparatus, the motion controller comprises, for each printing head:

a second encoder signal input configured to receive the second encoder signal;

a start/offset component coupled to the second encoder signal input, and configured to define a start timing and/or offset timing for the printing operation of the printing head;

a band compensation component coupled to the start/offset component, and configured to set a band compensation timing for the printing operation of the printing head;

a synchronization component coupled to the band compensation component, and configured to synchronize a timing of the printing operation of the printing head with a timing of printing operations of other printing heads;

a conversion component coupled to the synchronization component, and configured to convert the timing of the printing operation of the printing head to a desired printing resolution; and a printing head control signal output component coupled to the conversion component, and configured to supply a printing head control signal to the printing head.

Accordingly, the motion controller processes the second encoder signal to produce a different printing head control signal for each respective printing head. Account is taken of an offset between different printing heads, and a band compensation is performed (e.g. to compensate for an uneven distribution of a neutral line of the belt).

In a second aspect of the present invention, a method of digital inkjet printing on a sheet or web of material is provided. The method comprises: providing a belt for supporting and conveying the sheet or web of material fixed to the belt, the belt being guided along at least a first roller and a second roller, wherein the first roller has a first axis of rotation and is driven by a motor to rotate around the first axis of rotation, and the second roller has a second axis of rotation and is driven by the belt to rotate around the second axis of rotation; providing a plurality of printing heads arranged along the path of the belt; providing a first encoder associated with the first roller; and supplying a first encoder signal by the first encoder for controlling the operation of the motor. The method further comprises: providing a second encoder associated with the second roller; and supplying a second encoder signal by the second encoder for controlling the printing operation of each printing head.

These and other aspects of the invention will be more readily appreciated as the same becomes better understood by reference to the following detailed description and considered in connection with the accompanying drawings in which like reference symbols designate like parts.

BRIEF DESCRIPTION OF THE DRAWINGS

FIG. 1 schematically depicts a top view of a digital inkjet printing apparatus of the present invention, wherein printing heads are omitted for clarity.

FIG. 2 schematically depicts a side view of the digital inkjet printing apparatus of FIG. 1, showing printing heads, in combination with a diagrammatic view of a control system for controlling the digital inkjet printing apparatus.

DETAILED DESCRIPTION OF THE INVENTION

Figure 3:
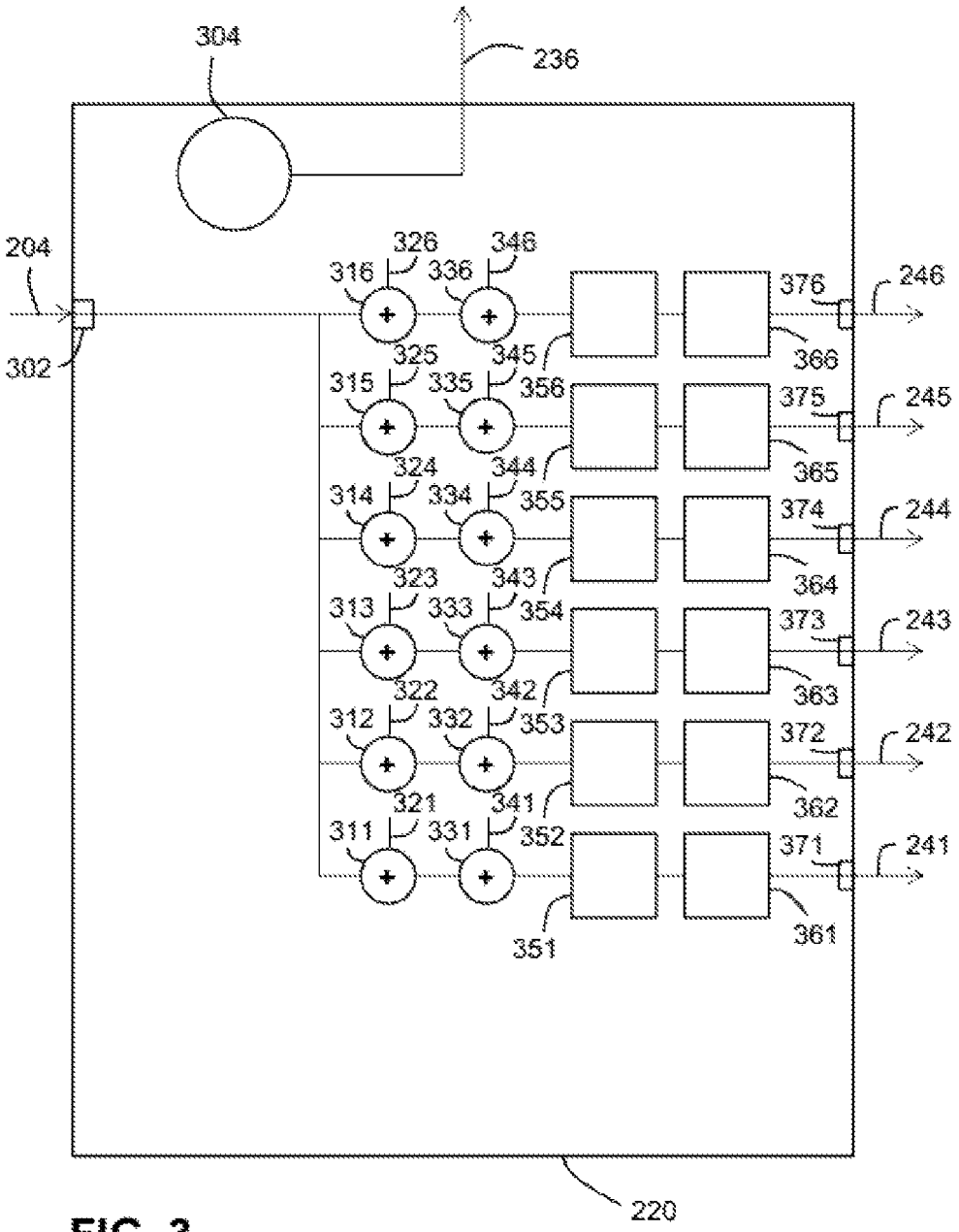
FIG. 3 diagrammatically depicts a motion controller of the control system of FIG. 2.

FIGS. 1 and 2 schematically depict a top view and a side view, respectively, of a digital inkjet printing apparatus 100 (hereinafter also referred to as printing apparatus 100) of the present invention. The printing apparatus 100 comprises at least a first roller 102 and a second roller 104, each mounted in a frame (not shown) by appropriate corresponding bearing structures (not shown), and configured to rotate around a first axis of rotation 103 and a second axis of rotation 105, respectively. A closed-loop belt 106 is fitted around the first roller 102 and the second roller 104. The printing apparatus 100 may comprise one or more further rollers (not shown), e.g. a tension roller to tension the belt 106.

A mechanical gear transmission 108 has an input shaft 112 and an output shaft. The first roller 102 is coupled to the output shaft of the mechanical gear transmission 108, whereas the input shaft 112 of the mechanical gear transmission 108 is coupled to an output shaft of a rotary motor 110. The motor 110 preferably is an electrical motor.

The motor 110 is configured to drive the first roller 102 to rotate around its first axis of rotation 103. The rotation of the first roller 102 causes the belt 106 to move in a selected one of the directions indicated by double arrow 107. The movement of the belt 106 causes the second roller 104 to rotate around its second axis of rotation 105. The second roller is not driven by other means.

Along the path of the belt 106, a plurality of printing heads 211, 212, 213, 214, 215, 216 are arranged. In the embodiment shown in FIG. 2, six printing heads 211-216 are shown. However, another number of printing heads, at least one, is also possible, with appropriate adaptation of the printing apparatus 100.

A first encoder 122 is associated to the first roller 102. The first encoder 122 is a rotary encoder and comprises, for example, a rotatable portion 122*a* and a stationary portion 122*b*, wherein the rotatable portion 122*a* is fixed to the first roller 102 to be rotated therewith, and the stationary portion 122*b* is fixed relative to the frame of the printing apparatus 100.

A second encoder 124 is associated to the second roller 104. The second encoder 124 is a rotary encoder and comprises, for example, a rotatable portion 124*a* and a stationary portion 124*b*, wherein the rotatable portion 124*a* is fixed to the second roller 104 to be rotated therewith, and the stationary portion 124*b* is fixed relative to the frame of the printing apparatus 100.

A third encoder 126 is associated to the motor 110. The third encoder 126 is a rotary encoder and comprises, for example, a rotatable portion 126*a* and a stationary portion 126*b*, wherein the rotatable portion 126*a* is fixed to the output shaft of the motor 110 to be rotated therewith, and the stationary portion 126*b* is fixed relative to the frame of the printing apparatus 100.

The first, second and third encoders 122, 124, 126 may be of the same type, or of different types. As an example, the encoders may be Sin/Cos encoders each providing a selected number of pulses per revolution. As an example, the first encoder 122 may generate 5000 pulses per revolution. As a further example, the second encoder 124 may generate 5000 pulses per revolution. As a still further example, the third encoder 126 may generate 2048 pulses per revolution.

The first encoder 122 is configured to supply a first encoder signal 202, the second encoder 124 is configured to supply a second encoder signal 204, and the third encoder 126 is configured to supply a third encoder signal 206, as symbolized by lines. Each one of the first encoder signal 202, the second encoder signal 204, and the third encoder signal 206 may be a pulse signal.

The first encoder signal 202 is input to a control system 220, in particular to a servo controller 230 of the control system 220, as a position signal. In the servo controller 230, the position signal is differentiated to obtain a speed signal.

Figure 4:
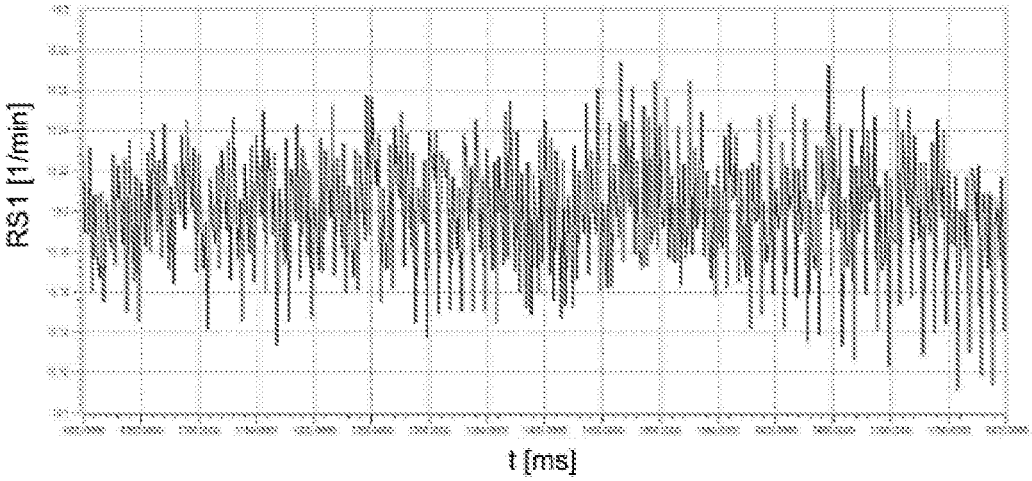
FIG. 4 illustrates a differentiated encoder signal provided by a first encoder coupled to a motor-driven roller of the digital inkjet printing apparatus of FIG. 1.

FIG. 4 illustrates the value of the differentiated first encoder signal provided by the first encoder 122 coupled to the motor-driven first roller 102 of the digital inkjet printing apparatus 100. The differentiated first encoder signal is representative of a rotational speed RS1 expressed in revolutions per minute, rpm, of the first roller 102 as a function of time t expressed in milliseconds, ms, at an RS1 set point of 19.2 rpm. With a circumference of 1.3 m of the first roller 102, this corresponds to a belt speed of 25 meters per minute. As can be seen in FIG. 4, the differentiated first encoder signal has a relatively large high frequency component, and therefore can be characterized as nervous.

The second encoder signal 204 is input to the control system 220, in particular to a motion controller 232 of the control system 220, as a position signal. In the motion controller 232, the position signal is differentiated to obtain a speed signal.

Figure 5:
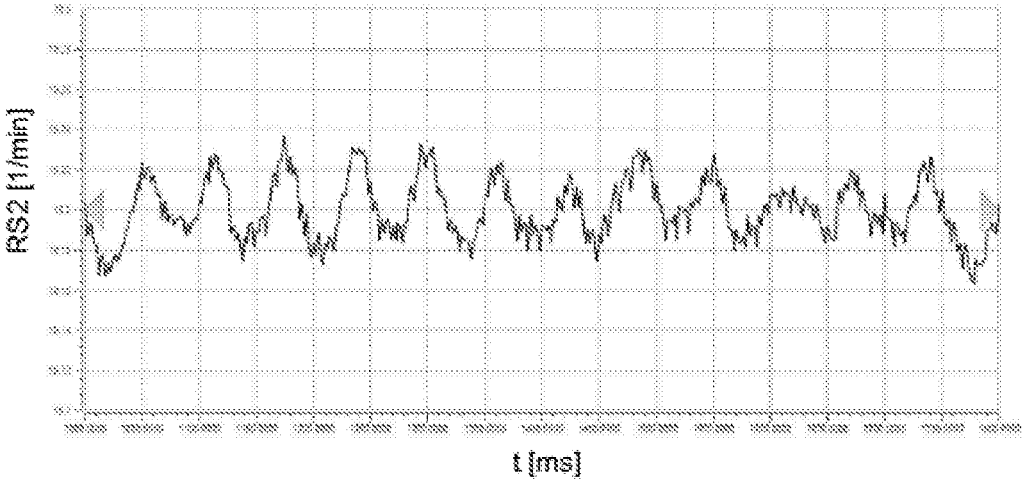
FIG. 5 illustrates a differentiated encoder signal provided by a second encoder coupled to a belt-driven roller of the digital inkjet printing apparatus of FIG. 1.

FIG. 5 illustrates the value of the differentiated second encoder signal provided by the second encoder 124 coupled to the belt-driven second roller 104 of the digital inkjet printing apparatus 100. The differentiated second encoder signal is representative of a rotational speed RS2 expressed in revolutions per minute, rpm, of the second roller 104 as a function of time t expressed in milliseconds, ms. As can be seen in FIG. 5, the differentiated second encoder signal has a substantially reduced high frequency component when compared to the differentiated first encoder signal, making the second encoder signal very suitable to accurately control the printing operation of the printing heads 211, 212, 213, 214, 215, 216 through the motion controller 232.

The third encoder signal 206 is input to the control system 220, in particular to the servo controller 230 of the control system 220, as a position signal. In the servo controller 230, the position signal is differentiated to obtain a speed signal.

Referring to FIGS. 2 and 3, the motion controller 232 provides a position command value 236 to the servo controller 230 from a virtual master axis component 304. The servo controller 230 controls the motor 110, as indicated by line 234.

The motion controller 232 comprises a second encoder signal input 302 configured to receive the second encoder signal 204.

For each printing head 211, 212, 213, 214, 215, 216, a respective start/offset component 311, 312, 313, 314, 315, 316 is coupled to the second encoder signal input 302, and configured to define a respective start timing and/or offset timing 321, 322, 323, 324, 325, 326 for the printing operation of the respective printing head 211, 212, 213, 214, 215, 216.

For each printing head 211, 212, 213, 214, 215, 216, a respective band compensation component 331, 332, 333, 334, 335, 336 is coupled to the respective start/offset component 311, 312, 313, 314, 315, 316, and configured to set a respective band compensation timing 341, 342, 343, 344, 345, 346 for the printing operation of the respective printing head 211, 212, 213, 214, 215, 216.

For each printing head 211, 212, 213, 214, 215, 216, a respective synchronization component 351, 352, 353, 354, 355, 356 is coupled to the respective band compensation component 331, 332, 333, 334, 335, 336, and configured to synchronize a timing of the printing operation of the respective printing head 211, 212, 213, 214, 215, 216 with a timing of printing operations of other printing heads.

For each printing head 211, 212, 213, 214, 215, 216, a respective conversion component 361, 362, 363, 364, 365, 366 is coupled to the respective synchronization component 351, 352, 353, 354, 355, 356, and configured to convert the timing of the printing operation of the respective printing head 211, 212, 213, 214, 215, 216 to a desired printing resolution.

For each printing head 211, 212, 213, 214, 215, 216, a respective printing head control signal output component 371, 372, 373, 374, 375, 376 is coupled to the respective conversion component 361, 362, 363, 364, 365, 366, and configured to supply a respective printing head control signal 241, 242, 243, 244, 245, 246 to the respective printing head 211, 212, 213, 214, 215, 216.

As explained in detail above, a digital printing apparatus for inkjet printing on a sheet or web of material apparatus comprises a belt for supporting and conveying the sheet or web of material fixed to the belt. The belt is guided along at least a first roller driven by a motor, and a second roller driven by the belt. A plurality of printing heads is arranged along the path of the belt. A control system is configured to control the operation of the motor and the printing operation of the printing heads. A first encoder being configured to supply a first encoder signal to the control system for controlling the operation of the motor, is associated with the first roller. A second encoder being configured to supply a second encoder signal to the control system for controlling the printing operation of each printing head, is associated with the second roller.

It is noted that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting, but rather, to provide an understandable description of the invention.

The terms "a"/"an", as used herein, are defined as one or more than one. The term plurality, as used herein, is defined as two or more than two. The term another, as used herein, is defined as at least a second or more. The terms including and/or having, as used herein, are defined as comprising (i.e., open language, not excluding other elements or steps). Any reference signs in the claims should not be construed as limiting the scope of the claims or the invention.

Although certain measures are recited in mutually different dependent claims, a combination of these measures can be used to advantage.

The term coupled, as used herein, is defined as connected, although not necessarily directly, and not necessarily mechanically, but also functionally.

A single processor or other processing unit may fulfil the functions of several items recited in the claims, such as the components in FIG. 3.

Functions of the control system 220 and/or servo controller 230 and/or motion controller 232 may be implemented in computer software (one or more computer programs), which is defined as a sequence of instructions designed for execution on a computer system. Computer software, a computer program, or a computer software application may include a subroutine, a function, a procedure, an object method, an object implementation, an executable application, an applet, a servlet, a source code, an object code, a shared library/dynamic load library and/or other sequence of instructions designed for execution on a computer system.

A computer program may be stored and/or distributed on a suitable medium, such as an optical storage medium or a solid-state medium supplied together with or as part of other hardware, but also be distributed in other forms, such as via the Internet or other wired or wireless telecommunication systems.

The invention claimed is:

1. A digital printing apparatus for inkjet printing on a sheet or web of material, the digital printing apparatus comprising:

a belt for supporting and conveying the sheet or web of material fixed to the belt, the belt being guided along a path by at least a first roller and a second roller, wherein the first roller has a first axis of rotation and is driven by a motor to rotate around the first axis of rotation, and the second roller has a second axis of rotation and is driven by the belt to rotate around the second axis of rotation;

a plurality of printing heads arranged along the path of the belt, each printing head being operable to print on the sheet or web of material;

a control system configured to control the operation of the motor and the printing operation of the printing heads;

a first encoder associated with the first roller, the first encoder being configured to supply a first encoder signal to the control system for controlling the operation of the motor; and a second encoder associated with the second roller, the second encoder being configured to supply a second encoder signal to the control system for controlling the printing operation of each printing head;

wherein the operation of the motor is not controlled by the second encoder signal; and wherein the printing operation of each printing head is not controlled by the first encoder signal.

2. The digital printing apparatus according to claim 1, wherein the control system comprises a servo controller for controlling the operation of the motor, and a motion controller for controlling the printing operation of each printing head.

3. The digital printing apparatus according to claim 2, wherein the first encoder signal is supplied to the servo controller.

4. The digital printing apparatus according to claim 3, wherein the first encoder signal is representative of the angular position of the first roller.

5. The digital printing apparatus according to claim 2, wherein the second encoder signal is supplied to the motion controller.

6. The digital printing apparatus according to claim 5, wherein the second encoder signal is representative of the angular position of the second roller.

7. The digital printing apparatus according to claim 2, further comprising a third encoder associated with the motor, the third encoder being configured to supply a third encoder signal to the servo controller for further controlling the operation of the motor.

8. The digital printing apparatus according to claim 7, wherein the third encoder signal is representative of the angular speed of the first roller.

9. The digital printing apparatus according to claim 2, wherein the motion controller comprises, for each printing head:

a second encoder signal input configured to receive the second encoder signal;

a start/offset component coupled to the second encoder signal input, and configured to define a start timing and/or offset timing for the printing operation of the printing head;

a band compensation component coupled to the start/offset component, and configured to set a band compensation timing for the printing operation of the printing head;

a synchronization component coupled to the band compensation component, and configured to synchronize a timing of the printing operation of the printing head with a timing of printing operations of other printing heads;

a conversion component coupled to the synchronization component, and configured to convert the timing of the printing operation of the printing head to a desired printing resolution; and a printing head control signal output component coupled to the conversion component, and configured to supply a printing head control signal to the printing head.

10. A method of digital inkjet printing on a sheet or web of material, the method comprising:

providing a belt for supporting and conveying the sheet or web of material fixed to the belt, the belt being guided along a path by at least a first roller and a second roller, wherein the first roller has a first axis of rotation and is driven by a motor to rotate around the first axis of rotation, and the second roller has a second axis of rotation and is driven by the belt to rotate around the second axis of rotation;

providing a plurality of printing heads arranged along the path of the belt, each printing head being operable to print on the sheet or web of material;

providing a first encoder associated with the first roller;

supplying a first encoder signal by the first encoder for controlling the operation of the motor;

providing a second encoder associated with the second roller; and supplying a second encoder signal by the second encoder for controlling the printing operation of each printing head;

wherein the operation of the motor is not controlled by the second encoder signal; and wherein the printing operation of each printing head is not controlled by the first encoder signal.

11. The digital printing method according to claim 10, wherein the first encoder signal is supplied to a servo controller for controlling the operation of the motor.

12. The digital printing method according to claim 11, wherein the first encoder signal is representative of the angular position of the first roller.

13. The digital printing method according to claim 11, further comprising:

providing a third encoder associated with the motor; and supplying a third encoder signal by the third encoder to the servo controller for further controlling the operation of the motor.

14. The digital printing method according to claim 13, wherein the third encoder signal is representative of the angular speed of the first roller.

15. The digital printing method according to claim 10, wherein the second encoder signal is supplied to a motion controller for controlling the printing operation of each printing head.

16. The digital printing method according to claim 15, wherein the second encoder signal is representative of the angular position of the second roller.

* * * * *